United States Patent [19]

Bonvallet

[11] Patent Number: 4,711,207

[45] Date of Patent: Dec. 8, 1987

[54] VALVE DEACTIVATOR MECHANISM

[75] Inventor: Duane J. Bonvallet, Ann Arbor, Mich.

[73] Assignee: General Motors Corporation, Detroit, Mich.

[21] Appl. No.: 35,181

[22] Filed: Apr. 7, 1987

[51] Int. Cl.[4] ..... F02D 13/06; F01L 13/00

[52] U.S. Cl. ..... 123/198 F; 123/90.16

[58] Field of Search ..... 123/198 F, 90.16

[56] References Cited

U.S. PATENT DOCUMENTS

| | | | |
|---|---|---|---|
| 4,200,081 | 4/1980 | Meyer et al. | 123/198 F |
| 4,249,489 | 2/1981 | Bruder et al. | 123/198 F X |
| 4,466,390 | 8/1984 | Babitzka et al. | 123/90.16 |

FOREIGN PATENT DOCUMENTS

| | | | |
|---|---|---|---|
| 2814164 | 10/1979 | Fed. Rep. of Germany | 123/90.16 |

*Primary Examiner*—Michael Koczo

*Assistant Examiner*—Peggy Neils

*Attorney, Agent, or Firm*—Arthur N. Krein

[57] ABSTRACT

A valve deactivator mechanism includes a flanged valve actuator that is operatively connected to a conventional spring biased poppet valve, either intake or exhaust, and which is slidably received in a flanged cam follower adapted to be reciprocated by an engine driven camshaft, a spring being operatively positioned to normally bias the flanges of the cam follower into engagement with each other and, a solenoid coil is operatively positioned such that when it is energized the flange of the valve actuator acting as an armature is electromagnetically coupled to the flange of the cam follower that operates as a solenoid pole piece whereby the cam follower actuates the valve actuator to control the opening and closing movement of the poppet valve and, when the solenoid coil is deenergized the valve actuator is uncoupled from the cam follower whereby the poppet valve is deactivated.

4 Claims, 3 Drawing Figures

VALVE DEACTIVATOR MECHANISM

This invention relates to a direct acting valve tappet mechanism for an overhead camshaft internal combustion engine and, in particular, to a solenoid actuated valve deactivator mechanism for such a direct acting valve tappet mechanism.

DESCRIPTION OF THE PRIOR ART

Various arrangements have been previously proposed to effect the deactivation of one or more valves in the valve train system in internal combustion engines. By way of one example there was disclosed in U.S. Pat. No. 4,337,738, entitled "Valve Control Mechanism", issued July 6, 1982 to Bubniak et al, whereon a rocker arm used to actuate a valve is normally fulcrummed intermediate its ends on an apertured pivot bearing slidably supported on a mounting stud with a slider support fixed to the mounting stud and a spring operatively supported between the slider support and the pivot bearing to normally bias the pivot bearing to an operative position at which the rocker arm is pivotable about the pivot bearing. A stepped slider was supported by the slider support for movement between a first position in which the rocker arm was fulcrummed by the pivot bearing and a second position permitting movement of the rocker arm to a position at which the rocker arm is then fulcrummed on the stem end of the associate valve.

As another example there is disclosed in U.S. Pat. No. 4,475,497, entitled "Internal Combustion Engine having an Intake/Exhaust Valve Assembly and Hydraulic Means for Rendering the Valve Assembly Inoperative", issued Oct. 9, 1984 to Honda et al, wherein a rocker arm actuated by an overhead camshaft is normally positioned for pivotable movement at one end thereof by a hydraulically extended hydraulic lash adjuster so as to actuate an associate valve, but when the axial extent of the hydraulic lash adjuster is reduced, the associate valve is deactivated.

In addition to the above, various arrangements have been proposed to deactivate one of a pair of adjacent valves such as the intake valves on a three or four valves per cylinder type internal combustion engine. Also various arrangements have been proposed relative to variable valve lift mechanisms such that the valve lift can be reduced to zero lift to thus in effect deactivate the associate valve.

SUMMARY OF THE INVENTION

The present invention relates to a valve deactivator mechanism wherein a cam follower is reciprocably journaled in a support housing, fixed to the cylinder head of an engine, whereby the cam follower is positioned to be actuated by a cam on an engine driven camshaft, the cam follower, at one end thereof, is provided with a flange that can be magnetically coupled to an inverted cup-shaped valve actuator by a solenoid when the solenoid coil thereof is energized so that the valve activator can effect opening and closing of a valve that is normally biased to a closed position by a valve return spring, with the spring retainer of the valve operatively supporting a lash adjuster between the valve and the valve actuator, and when solenoid coil is deenergized, the cam follower is operatively disengaged from the valve actuator but is held in operative engagement with the cam by a spring engaging both the cam follower and the valve actuator with a bias force less than the bias force of the valve return spring.

It is therefore a primary object of this invention to provide an improved valve deactivator mechanism which includes a cam follower directly actuated by a cam on an engine driven camshaft, a valve actuator for an associate valve which is adapted to be electromagnetically coupled to the cam follower when valve actuation is desired and which can be uncoupled from the cam follower when valve deactivation is desired.

Accordingly, another object of this invention is to provide an improved direct acting valve tappet mechanism for use in an overhead camshaft type internal combustion engine that includes a solenoid with a coil which when energized permits a cam follower to operatively engage a valve actuator coupled to a valve via a lash adjuster and which when deenergized permits axial movement of the cam follower relative to the valve actuator whereby the valve is deactivated.

For a better understanding of the invention, as well as other objects and further features of the invention, reference is had to the following detailed description to be read in connection with the accompanying drawings.

DESCRIPTION OF A PREFERRED EMBODIMENT

Figure 1:
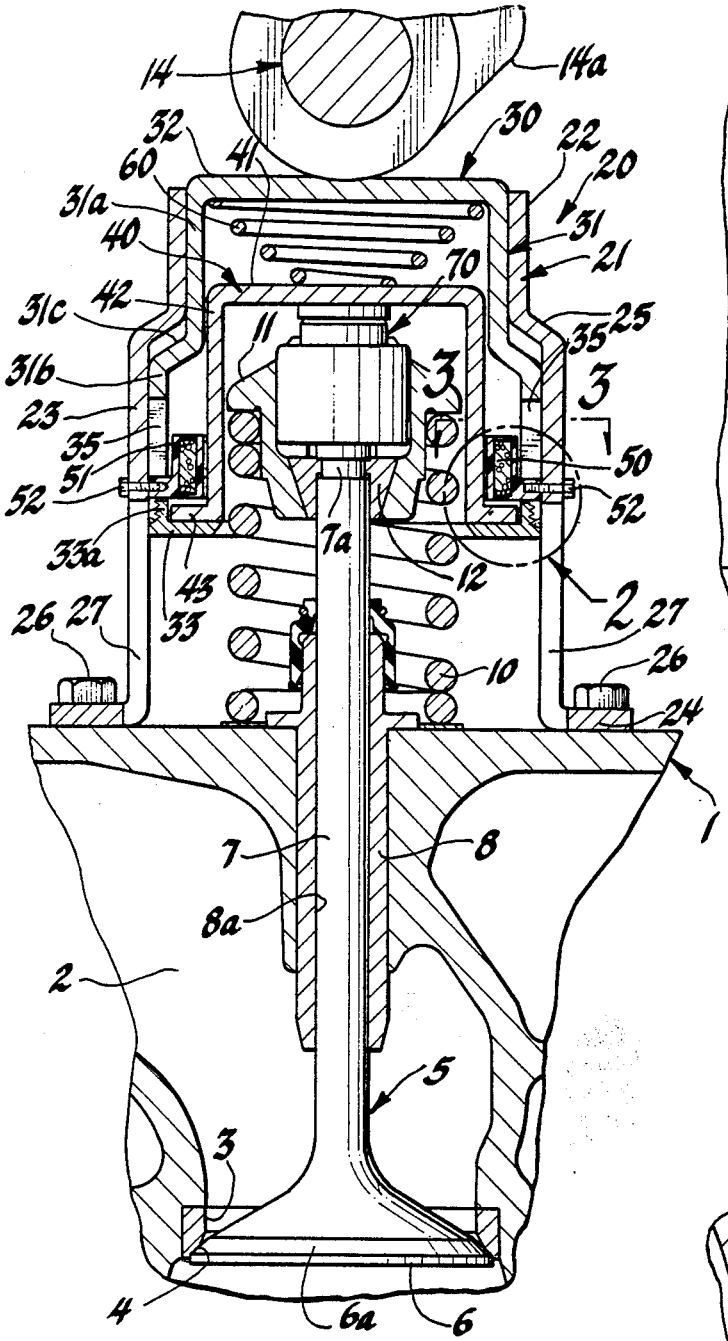
FIG. 1 is a cross-sectional view of a portion of an overhead camshaft type internal combustion engine having a valve deactivator mechanism in accordance with a preferred embodiment of the invention incorporated therein, with the solenoid thereof being illustrated schematically.

Referring first to FIG. 1 there is shown a portion of an overhead cam type internal combustion engine having a cylinder block means defining a cylinder, not shown, the cylinder block means including a cylinder head 1 with a passage 2 therein, which may be an intake or exhaust passage, terminating at a port 3 encircled by a valve seat 4, that opens into the cylinder, not shown.

Flow through the port 3 is controlled by a poppet valve 5 having a head 6 with a seat *6a* thereon for seating against the valve seat 4 and a valve stem 7 slidably supported in a valve guide bore *8a*, which in the construction shown is formed in a valve guide 8 suitably fixed in the cylinder head 1.

A valve return spring 10 bears at its upper end against a tubular, spring retainer 11 secured to the upper end of the valve stem 7 by split locks 12 engaged in the groove *7a* of the valve stem 7 in a conventional manner.

An engine driven camshaft 14 having at least one cam *14a* thereon is rotatably supported in a conventional manner, not shown, a predetermined distance above the upper end of the valve stem 7 to normally control the movement of the poppet valve 5 between a valve closed position, as shown in FIG. 1, and a valve open position relative to the valve seat 4.

As shown in FIG. 1, a valve deactivator mechanism, generally designated 20, is operatively positioned between the valve stem 7 and the camshaft 14. In the construction shown, the valve deactivator mechanism 20 includes a tubular, cam follower guide housing 21 of stepped external/internal configuration that includes a tubular, straight walled, upper guide portion 22 of a predetermined internal diameter, a straight walled, lower portion 23 of a predetermined internal diameter than the upper guide portion 22 and which at its lower end is connected to a radial outward extending annular base flange 24. The upper guide portion 22 and lower portion 23 are interconnected by an inclined housing portion 25.

The base flange 24 of the cam follower housing 21 is provided with a plurality of circumferentially spaced apart apertures, not shown, to receive machine screws 26 threaded into suitably located internally threaded apertures, not shown, provided for this purpose in the cylinder head 1 whereby the cam follower guide housing 21 can be secured to the cylinder head 1 with its axis being located substantially coaxial with the reciprocating axis of the poppet valve 5. Also, as best seen in FIG. 1, the lower portion 23 of the cam follower housing 21 is provided with a plurality of circumferentially spaced apart slots 27 of predetermined axial extent for a purpose to be described hereinafter.

Reciprocably journaled within the cam follower guide housing 21 is a cam follower 30, of inverted cup-shaped configuration, that includes a tubular follower body 31 of stepped external configuration somewhat conforming to the internal configuration of the cam follower guide housing 21, so as to include an upper external bearing portion **31*a* guidingly received by the internal wall of the upper guide portion 22, a lower portion 31*b* loosely slidably received in the lower portion 23 with these portions being interconnected by an inclined wall 31*c*, and an upper cam engaging foot 32 which can be formed integral with the upper bearing portion 31*a*, as shown, or which can be formed as a separate element that is secured as by brazing or welding to the upper bearing portion 31*a*** in a manner well known in the art.

In addition, as a feature of the invention, the lower portion **31*b* of the follower body 31 terminates in a radially inward extending flange portion 33 which together with the lower portion 31*b* of the cam follower 30** serves as a pole piece of a solenoid assembly to be described hereinafter.

For ease of assembly of the remaining elements of the valve deactivator mechanism of the invention to be described hereinafter, the follower body 31 and the flange portion 33 are formed as separate elements with the latter, as formed as a separate element, being provided with an upstanding externally threaded leg **33*a* for threaded engagement with the reduced internal diameter, internally threaded 31*b*' lower portion of the lower portion 31*b*. Preferably as originally formed, the follower body 31 and flange portion 33 are made oversize relative to their respective outer peripheral surfaces, and then after being threaded together, as shown, the outer peripheral surfaces are machined for the respective desired sliding fit of the cam follower 30 in the cam follower guide housing 21. Thereafter, the flange portion 33 is unscrewed from the remainder of the follower body 31** for a purpose that will become apparent hereinafter.

To effect such assembly and disassembly, the flange portion 33 and, for example, the upper cam engaging foot 32 can be provided, for example, with suitable apertures, not shown, for engagement by suitable spanner wrenches.

In the construction shown, the cam follower 30 is made for example, of silicon core iron and the wear surfaces thereof such as the upper surface of the cam engaging foot 32 and the external bearing portion **31*a*** can be selectively hardened in a suitable manner, as disclosed, for example, in U.S. Pat. No. 4,231,555, issued Nov. 4, 1980 to James D. Palma, the disclosure of which is incorporated herein by reference thereto.

Figure 2:
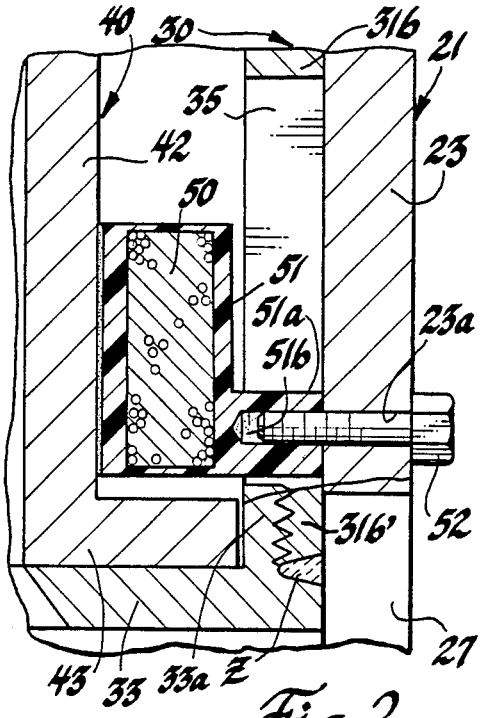
FIG. 2 is an enlarged cross-sectional view of a portion of the valve deactivator mechanism of FIG. 1 as shown in the circled section 2 of FIG. 1; and, FIG. 3 is an enlarged sectional view taken along line 3—3 of FIG. 1.

Slidably mounted within the cam follower 30 is a valve actuator 40 of inverted cup-shaped configuration so as to define a base or closed end wall 41 with a tubular shell 42 depending therefrom, the shell 42 terminating at its lower end, as best seen in FIGS. 1 and 2, in a radial outward extending annular flange 43 having a flat bottom surface so as to extend in parallel relationship over the flange portion 33 of the cam follower 30. The valve actuator is made of a suitable magnetically soft material so that the annular flange 43 and the interconnecting portion of the shell 42 will, in effect, constitute an armature.

Figure 3:
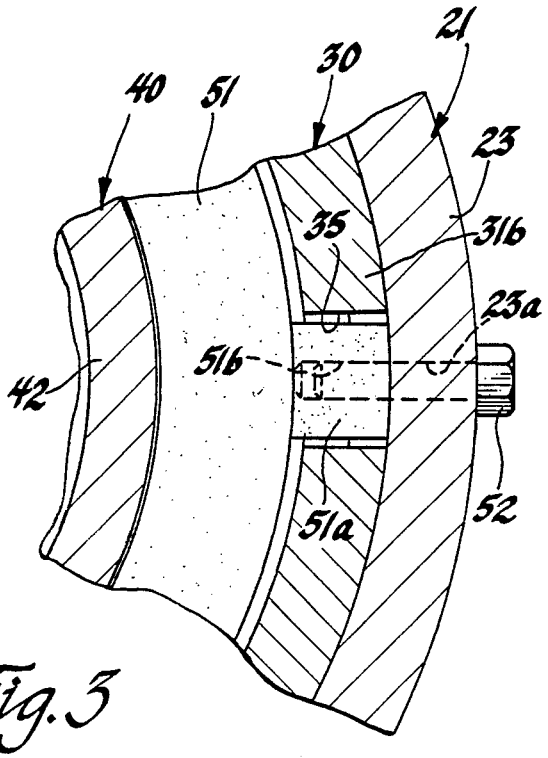

Positioned closely above the flange 43 so as to loosely encircle the shell 42 of the valve actuator 40 is a solenoid coil 50 wound in an enclosed bobbin 51 that is of ring like configuration but which has, in the construction shown, a plurality of circumferentially spaced apart radially outward extending legs **51*a* each having an internally threaded aperture 51*b* therein to threadingly receive an associate mounting screw 52 extending through a suitable associate aperture 23*a* in the lower portion 23 of the cam follower guide housing 21 as shown in FIGS. 1–3. In addition the bobbin 51 is provided with another radially outward extending leg, having a socket therein, both not shown, with this leg being of a suitable radial extent whereby to extend through a slot 27 in the cam follower guide housing 31, which is of an axial extent greater than the remaining slots 27, as seen in FIG. 1, so that this socket leg, not shown, can be used to effect angular orientation of the bobbin 51 so that the apertures 51*b* in the bobbin legs 51*a* are aligned with the apertures 23*a* in the cam follower guide housing 31**.

This leg with the socket therein, both not shown, is adapted to support a pair of conventional terminal leads, not shown, each of which is connected to an associate end of the solenoid coil 50 whereby the solenoid coil 50 can be connected to a source of electrical power as controlled by a suitable electronic control circuit, such as a conventional vehicle onboard computer as well known in the electronic fuel injection art. As best seen in FIGS. 1 and 2, each of the legs **51*a* of the bobbin 51 slidably extend through an associate slot 35 of suitable extent provided for this purpose in the cam follower 30 so that the cam follower 30 is free to reciprocate relative to the bobbin 51 and solenoid coil 50**.

Again referring to FIG. 1, a coil spring 60, of a predetermined bias force less than that of the valve return spring 10, is positioned between the upper surface of the closed end wall 41 of the valve actuator 40 and the inboard surface of the cam engaging foot 32 of the cam follower 30 so as to bias the cam follower into operating engagement with the cam **14*a* and to bias the valve actuator 40 in a direction, downward with reference to FIG. 1, so that its flange 43 engages the flange 33 of the cam follower 30**.

In addition, a lash adjuster 70 is operatively positioned between the valve stem 7 end of the poppet valve 5 and the lower surface of the closed end wall 41 of the valve actuator 40. Although the lash adjuster 70 can be any conventional hydraulic or mechanical type lash adjuster, it is preferably in the form of a conventional, self contained hydraulic lash adjuster that is of a suitable size whereby it can be operatively retained within the upper portion of the tubular spring retainer 11, as shown in FIG. 1.

As should now be apparent, the main body portion of the cam follower 30; solenoid coil 50 and bobbin 51; spring 30; and, valve actuator 40 are first mounted in the cam follower guide housing 21, after which the flange 33 is again threaded to the main body portion of the cam follower 30, after which the flange 33 is fixed thereto at the interface between the main body portion of the cam follower 30 and flange 33 as by electron beam or laser welding as at Z at spaced apart locations corresponding to the location of the slots 27 in the cam follower guide housing 21. As shown, these slots 27 are of a suitable axial extent to permit this welding operation. It will however be apparent to those skilled in the art, that those slots 27 used merely for the welding operation could be replaced by similarly located apertures, not shown.

The axial extent between the upper surface of the foot 32 and the upper surface of the flange 33 of the cam follower 30, as well as the axial extent of the lower surface of the closed end wall 41 and lower surface of the flange 43 of the valve actuator 40 are preselected relative to the predetermined maximum and minimum axial extent of the lash adjuster 70, such that, when the foot 32 of the cam follower 30 is riding on the base circle of the cam **14*a*, the position shown in FIG. 1, the valve actuator 40 will be biased by the spring 60 so that its flange 43 will be forced into abutment against the flange 33 of the cam follower 30. However, as previously described, the force of spring 60 being less than the force of the valve return spring 10, this spring 60, per se, will not be effective to cause any axial displacement of the poppet valve 5** in a valve opening direction.

Function Operation

During normal engine operation, the solenoid coil 50 will be continuously energized, as controlled by the electronic control unit, not shown, so that an electromagnetic field whose flux path passes through the opposed working surfaces of the flanges 33 and 43 (pole piece and armature, respectively) will cause the valve actuator 40 to be magnetically coupled to the cam follower 30 so that during reciprocation of the cam follower 30 by cam **14*a* the valve actuator 40 will also be reciprocated accordingly to control the opening and closing movement of the poppet valve 5**.

Because the spring 60 is operative to bias the flanges 33 and 44 so that a zero clearance exists at their interface, the solenoid coil 50, when energized, can generate the required electromagnetic force at relatively low power, to operatively maintain the cam follower 30 and valve actuator 40 electromagnetically connected together.

However, when it is desired to deactivate the poppet valve 5, the solenoid coil 50 is deenergized, preferably as when this poppet valve 5 is in a valve closed position. This will then, in effect, uncouple the cam follower 30 from the valve actuator 40 so that the cam follower 30 is free to reciprocate relative to the then stationary valve actuator 40, with the spring 60 still maintaining the cam follower 30 in operative engagement with the cam **14*a*. However, even during reciprocation of the cam follower 30 in a downward direction, with reference to FIG. 1, so as to compress the spring 60, this bias force of spring 60 will still be less than the bias force of the valve return spring 10**, whereby the poppet valve will remain in its valve closed position and, accordingly, this poppet valve is thus deactivated.

If the poppet valve 5 is to again be made operative, the solenoid coil 50 can be again energized at any time as desired, but valve operation will only occur after the cam follower 30 again engages the base circle of the cam **14*a* so that the interface between the opposed working surfaces of the flanges 33 and 43 is again affected whereby the cam follower 30 and valve actuator 40** will again be electromagnetically coupled together.

While the invention has been described with reference to the structure disclosed herein, it is not confined to the specific details set forth, since it is apparent that many modifications and changes can be made by those skilled in the art. For example, although the subject valve deactivator mechanism has been shown as used with an overhead cam, it will be apparent that it can be incorporated into other type valve train arrangements. In addition, it will also be obvious to one skilled in the art, that the flange of the valve actuator can be arranged to be used as the solenoid pole piece and the flange of the cam follower can be arranged to be used as the armature. This application is therefore intended to cover such modifications or changes as may come within the purposes of the improvements or scope of the following claims.

The embodiments of the invention in which an exclusive property or privilege is claimed are defined as follows:

1. A valve deactivator mechanism for use in an internal combustion engine of the type having an engine block means defining a cylinder with a port, a poppet valve operatively positioned to control flow through the port and having a valve stem reciprocably journaled in the cylinder head with one end thereof extending outboard of the cylinder head with a valve spring associated therewith to normally bias the poppet valve to a valve closed position in the port, and an engine driven valve actuator means spaced from the poppet valve, the improvement comprising;

a tubular cam follower guide housing means operatively fixed to the cylinder head substantially concentric with and encircling the valve stem of the poppet valve; a cam follower of inverted cup-shaped configuration slidably journaled for reciprocation in said cam follower guide housing means, said cam follower having a foot at one end thereof positioned to be engaged by the valve actuator means and a radially inward extending annular flange at its opposite end to define a solenoid pole piece; a valve actuator of inverted cup-shaped loosely positioned in said cam follower and operatively connected to the valve stem of the poppet valve, said valve actuator having a closed end at one end thereof and having at its open end a radially outward extending annular flange defining an armature; a spring means operatively positioned between said closed end of said valve actuator and the foot of said cam follower to normally bias the said flanges of said cam follower and of said valve actuator into abutment with each other; and, a solenoid coil and bobbin means fixed to said cam follower guide housing means so as to loosely encircle said valve actuator and positioned to generate an electromagnetic flux path when said solenoid coil is energized that passes through the opposed working surfaces of said flanges whereby said valve actuator is electromagnetically connected to said cam follower for movement therewith, the arrangement being such that when the said solenoid coil is deenergized, said valve actuator is operatively uncoupled from said cam follower to effect deactivation of the poppet valve.

2. A valve deactivator mechanism according to claim 1 further including a lash adjuster operatively positioned between the valve stem end of the poppet valve and said closed end of said valve actuator.

3. A valve deactivator mechanism for use in an internal combustion engine of the type having an engine block means defining a cylinder with a port, a poppet valve operatively positioned to control flow through the port and having a valve stem reciprocably journaled in the cylinder head with one end thereof extending outboard of the cylinder head and having a valve spring associated therewith to normally bias the poppet valve to a valve closed position in the port, and an engine driven valve actuator means spaced from the poppet valve, the improvement comprising;

a tubular cam follower guide housing means operatively associated with the cylinder head and positioned substantially concentric with and loosely encircling the valve stem of the poppet valve; a cam follower of inverted cup-shaped configuration slidably journaled for reciprocation in said cam follower guide housing means, said cam follower having a foot at one end thereof positioned to be engaged by the valve actuator means and a radially inward extending annular flange at its opposite end; a valve actuator of inverted cup-shaped loosely positioned in said cam follower and operatively connected to the valve stem of the poppet valve, said valve actuator having a closed end at one end thereof and having at its open end a radially outward extending annular flange; a spring means operatively positioned between said closed end of said valve actuator and the foot of said cam follower to normally bias the said flanges of said cam follower and of said valve actuator into abutment with each other; said cam follower and its said flange and said valve actuator and its said flange being of a suitable material whereby one of said flanges is operative as a solenoid pole piece and the other one of said flanges is operative as an electromagnetic armature and, a solenoid coil and bobbin means fixed to said cam follower guide housing means so as to loosely encircle said valve actuator and positioned to generate an electromagnetic flux path when said solenoid coil is energized that passes through the opposed abutting working surfaces of said flanges whereby said valve actuator is electromagnetically connected to said cam follower for movement therewith, the arrangement being such that when the said solenoid coil is deenergized, said valve activator is operatively uncoupled from said cam follower to effect deactivation of the poppet valve.

4. A valve deactivator mechanism according to claim 3 further including a lash adjuster operatively positioned between the valve stem end of the poppet vale and said closed end of said valve actuator.

* * * * *